US005495683A

United States Patent [19]

Miotto et al.

[11] Patent Number: 5,495,683

[45] Date of Patent: Mar. 5, 1996

[54] ENGAGEMENT DEVICE PARTICULARLY FOR TOOTHED BANDS FOR SPORTS SHOES

[75] Inventors: Onorio Miotto, S. Stefano Di Valdobbiadene; Claudio Zorzi, Paderno de Ponzano Veneto, both of Italy

[73] Assignees: Nordica S.p.A., Trevignano; AM S.r.l., Monsigo Di Moriago Della Battaglia, both of Italy

[21] Appl. No.: 195,104

[22] Filed: Feb. 14, 1994

[30] Foreign Application Priority Data

Apr. 15, 1993 [IT] Italy ..... TV93U0020

[51] Int. Cl.[6] ..... A43B 5/04; A43B 11/00; A43C 11/00

[52] U.S. Cl. ..... 36/50.5; 36/50.1; 36/115; 24/68 SK

[58] Field of Search ..... 36/50.5, 50.1, 36/115; 24/68 SK, 70 SK, 71 SK, 16 PB, 30.5 P

[56] References Cited

U.S. PATENT DOCUMENTS

| | | | |
|---|---|---|---|
| 3,214,808 | 11/1965 | Litwin | 24/16 PB |
| 3,924,299 | 12/1975 | McCormick . | |
| 4,092,765 | 6/1978 | Joyce | 24/16 PB |
| 4,136,148 | 1/1979 | Joyce | 24/16 PB X |
| 4,287,644 | 9/1981 | Durand | 24/16 PB |
| 4,310,951 | 1/1982 | Riedel | 36/50.5 X |
| 4,615,185 | 10/1986 | Bollinger | 24/16 PB X |
| 4,670,946 | 6/1987 | Olivieri | 36/50.5 X |
| 4,683,620 | 8/1987 | Valsecchi et al. | 36/50.5 X |
| 4,708,306 | 11/1987 | Mitomi | 24/16 PB X |
| 4,882,813 | 11/1989 | Nakamura | 24/16 PB |
| 5,293,669 | 3/1994 | Sampson | 24/16 PB |

FOREIGN PATENT DOCUMENTS

| | | | |
|---|---|---|---|
| 0220784 | 5/1987 | European Pat. Off. . | |
| 1573303 | 5/1969 | France | 24/16 PB |
| 2282062 | 3/1976 | France . | |
| 2380796 | 9/1978 | France . | |
| 2228243 | 1/1973 | Germany | 24/16 PB |
| 3248770 | 7/1984 | Germany | 24/68 SK |
| 2106982 | 4/1983 | United Kingdom | 24/30.5 P |

*Primary Examiner*—Paul T. Sewell
*Assistant Examiner*—Ted Kavanaugh
*Attorney, Agent, or Firm*—Guido Modiano; Albert Josif

[57] ABSTRACT

An engagement device, particularly usable for toothed bands of sports shoes, such as for example ski boots, roller skates or ice skates, including a single body that can be associated with the shoe and has at least one first slot for the sliding insertion of the toothed band. First teeth for the temporary engagement with traction of the band are provided at the first slot. There is also a curved surface suitable to force the interaction of the set of teeth of the band with the first teeth.

15 Claims, 2 Drawing Sheets

ENGAGEMENT DEVICE PARTICULARLY FOR TOOTHED BANDS FOR SPORTS SHOES

BACKGROUND OF THE INVENTION

The present invention relates to an engagement device particularly usable for toothed bands of sports shoes, such as for example ski boots, ice skates or roller skates.

Currently, these kinds of shoes are usually constituted by a shell with which at least one quarter is associated.

In order to secure the shell or the quarter it is known to use levers which are pivoted to a baseplate, that must be associated for example with a flap of the shell, and interact for example with the end of a toothed band which is associated, at its other end, with the other flap of the shell by virtue of mechanical retention means, such as for example a block provided with a pawl that can be actuated by means of a pushbutton and with which the set of teeth of the band engages.

This solution for engaging the band with the shell or quarter has some drawbacks: in fact, on one hand the block must be riveted to the shell or quarter, and on the other hand said block protrudes from said shell or quarter.

Thus, in case of accidental impacts said block cannot be replaced by the user, as replacement usually requires the aid of specialized personnel.

Last but not least, the block has a certain number of components, such as the pawl, the baseplate, one or more springs, pivots and rivets, which require assembly operations to obtain the finished part.

For example, U.S. Pat. No. 4,229,862 discloses a lever connectable to a baseplate which can be associated with the shell or with the quarter by means of a link; said lever has, between its wings, a ratchet-like element that interacts with a toothed band insertable between said ratchet-like element and the lever.

This solution is constructively complicated and in any case, as regards the engagement with the shell or quarter, it has considerable protrusions that can lead to unwanted accidental impacts.

SUMMARY OF THE INVENTION

A principal object of the present invention is therefore to eliminate the above-described drawbacks in known types by providing an engagement device that allows to rapidly and easily connect a toothed band with a shell or a quarter and at the same time has very limited protrusions with respect to said shell or quarter.

Within the scope of this object, another important object is to provide an engagement device that allows to optimally lock one end of a toothed band that interacts, at its other end, with a lever for tensioning it.

Another important object is to provide an engagement device in which it is possible to adjust the useful length of the band without requiring levers or moving elements such as pawls that interact in a ratchet-like manner with the set of teeth of said band.

Another important object is to provide an engagement device which is reliable and safe in use and has a very simple structure, an extremely small number of components and low manufacturing costs.

With these and other objects in view, there is provided, according to the present invention, an engagement device particularly for toothed bands of sports shoes, such as ski boots, roller skates or ice skates, comprising a body associable with a shoe portion and having at least one first slot for the sliding insertion of the loose end of said toothed band, first means for the temporary engagement with traction of said band being provided. The first means may be provided at said at least one first slot, and said device is further provided with second supporting means suitable to force the interaction of the set of teeth of said band with said first means.

BRIEF DESCRIPTION OF THE DRAWINGS

Further characteristics and advantages of the present invention will become apparent from the following detailed description of a particular embodiment thereof, illustrated only by way of non-limitative example in the accompanying drawings, wherein.

DESCRIPTION OF THE PREFERRED EMBODIMENTS

Figure 1:
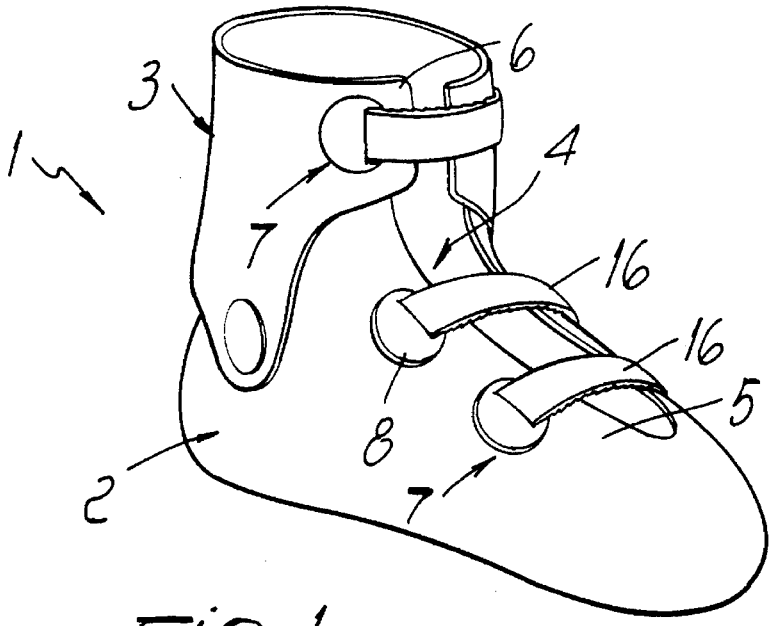
FIG. 1 is a lateral perspective view of a shell with which a quarter is associated and to which the engagement device is applied.
Figure 2:
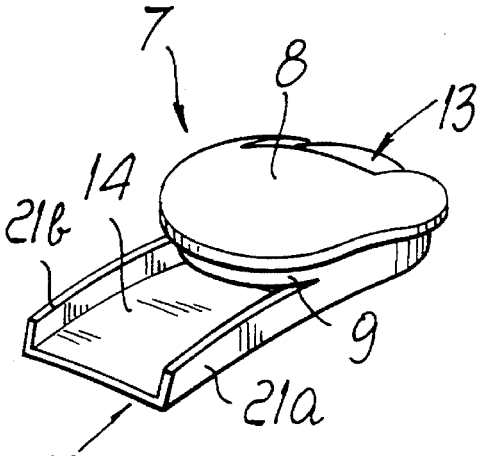
FIG. 2 is a first lateral perspective view of the device.
Figure 3:
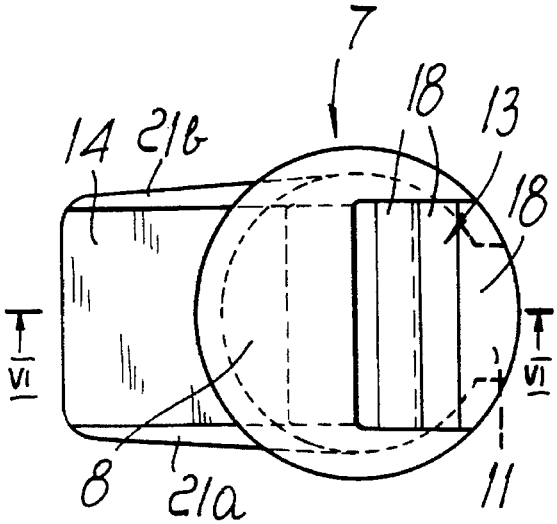
FIG. 3 is a top view of the device.
Figure 4:
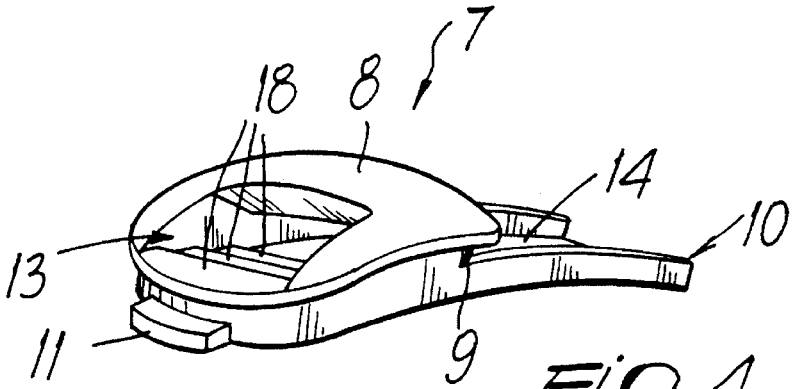
FIG. 4 is a second lateral perspective view of the device.

With reference to the above figures, the reference numeral 1 designates a sports shoe having an upper comprising a shell 2 to which at least one quarter 3 is articulated.

The engagement device, designated by the reference numeral 4, is associable at a closeable portion of the boot, particularly at a flap 5 of the shell 2 or at a lateral end 6 of the quarter 3.

Said engagement device is constituted by a single body 7, made of rigid plastics, which has a head 8 below which an annular ridge 9 is joined to a tab 10 which protrudes radially from said ridge; a lug 11 protrudes on the opposite side from the annular ridge 9.

Advantageously, the height of the annular ridge 9 is approximately equal to the thickness of the shell 2 and of the quarter 3, so as to allow the snap-together insertion, within the shell or quarter, of the tab 10 through an adapted hole 12 formed on said shell or quarter.

A first slot 13 is formed at the head 8, which is hollow; first means for the temporary engagement with traction of a band 16 are provided at said slot, and said band has a set of teeth 17 which is directed toward the shell or quarter.

Preferably, the first slot 13 is formed along an axis which is approximately transverse to the tab 10.

Said first means are thus constituted by one or more first teeth 18 formed at the end of the first slot 13 which is adjacent to the lug 11.

Preferably, the first teeth 18 have mutually different angles and dimensions: starting from the region adjacent to the lug 11 toward the tab 10, said first teeth increase in size and advantageously differ in their inclination.

In any case, the inclination of the first teeth 18 is generally opposite to the inclination of the set of teeth 17 of the band 16, so that the loose end or free end 19 of said band, once it has been inserted in the first slot 13, cannot be extracted by applying an axial force, due to the engagement of the teeth 17 with the first teeth 18.

Figure 6:
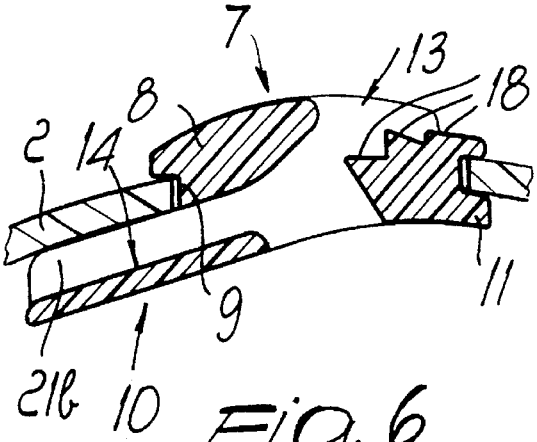
FIG. 6 is a sectional view of the device taken along the plane VI—VI of FIG. 3.
Figure 5:
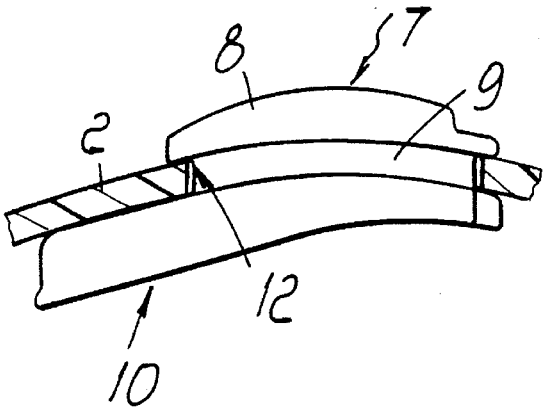
FIG. 5 is a side view of the device, applied to a sports shoe portion.
Figure 7:
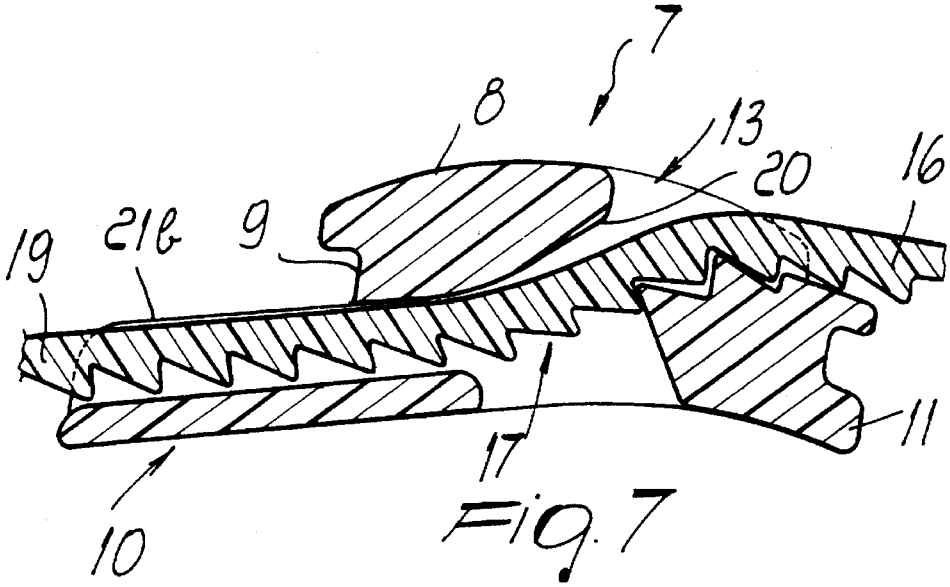
FIG. 7 is a view, similar to the preceding one, of the device with the toothed band inserted therein.
Figure 8:
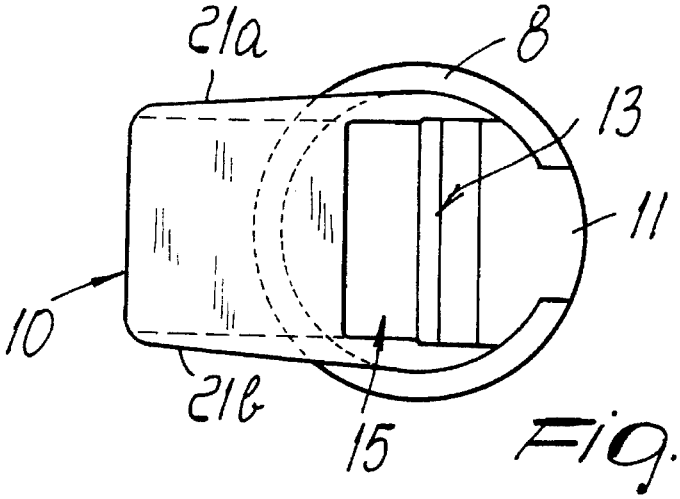
FIG. 8 is a bottom view of the device.

A curved surface 20 is formed inside the head 8 on the side opposite to the first teeth 18 and facilitates the insertion of the loose end 19 of the band. As clearly shown in FIGS. 6 and 7, the first teeth 18 progressively decrease in size in a direction extending away from the curved surface 20.

Furthermore, the inclination of said curved surface 20 is such that the loose end 19 of the band 16 interacts, during insertion thereof in the first slot 13, with the bottom 14 of the tab 10.

Said tab, which advantageously is laterally provided with walls 21*a* and 21*b*, constitutes the second supporting means for said band.

Said second means, and thus the particular curved surface 20 and the bottom 14 of the tab 10, are suitable to force interaction of the set of teeth 17 of the band 16 with the first temporary engagement means and thus with the first teeth 18, ensuring engagement thereof.

The plane of arrangement of the bottom 14 is in fact at a lower level than the plane of arrangement of the first teeth 18.

Use of the device is as follows: once the body 7 has been associated with the shell or quarter, the loose end 19 of the band 16 is inserted through the first slot 13.

In this manner, the loose end 19 is guided, by means of the curved surface 20, to the bottom 14 of the tab 10, giving the band 16 an S-shaped deformation that ensures reliable engagement of the set of teeth 17 with the first teeth 18. As clearly shown in FIG. 7, the S-shaped deformation is imparted to the band 16 by the bottom 14 of the tab 10, the curved surface 20 and the first teeth 18, which together, define a substantially S-shaped path for the band 16.

The other end of the band 16 must naturally be connected to a lever which, during the securing operation, further forces the set of teeth 17 of the band 16 to interact with the first teeth 18 i.e., by moving the band 16 in a direction extending away from the curved surface 20 and towards the first teeth 18.

By lifting the band 16, it is possible to vary its useful length, inserting it fully or partially in the first slot 13. The band 16 is movable within the slot 13, in a direction extending away from the first teeth 18 and towards the curved surface 20, for disengaging the plurality of teeth 17 from the first teeth 18 and thus releasing the closeable flap 5 of the shell 3 or the lateral end 6 of the quarter 2.

It has thus been observed that the invention has achieved the intended aim and objects, an engagement device for toothed bands having been obtained which allows optimum coupling to the loose ends of said bands and to select their useful length with the assurance of optimum resistance to axial tractions applied to the band, although the device maintains an extremely simple structure with an extremely reduced number of components.

Furthermore, the shape of the head 8 and of the body 7 is such that only a very limited part protrudes with respect to the outer lateral surface of the shell and of the quarter, said part being deprived of catches for blunt bodies, such as for example the poles and the ground during sports practice.

The engagement device according to the invention is naturally susceptible to numerous modifications and variations, all of which are within the scope of the same inventive concept.

We claim:

1. A device for engaging toothed closure bands (16, 18) in sports shoes (1,2,3,5,6) comprising;

a body (7) defining a head (8);

a tab (10) connected to said body (7) at an opposite side thereof with respect to said head (8);

an elongate bottom (14) defined by said tab (10);

a slot (13) formed in said head (8) for insertion of a toothed band (16, 18), said slot (13) extending transversely with respect to said tab (10) and said bottom (14);

a curved surface (20) formed in said head (8) adjacent said slot (13), and;

toothed engagement means (18) located at said slot (13) at a side thereof opposite said curved surface (20) for releasably engaging a toothed band (16, 18), said bottom (14), said toothed engagement means (18) and said curved surface (20) together defining a substantially S-shaped path for a toothed band (16, 18).

2. The device according to claim 1, wherein said toothed engagement means (18) comprise a plurality of first teeth (18), said plurality of first teeth (18) progressively decreasing in size in a direction extending away from said curved surface (20).

3. The device according to claim 1, further comprising;

a ridge (9) formed below said head (8), said tab (10) protruding from said ridge (9) at one side thereof, and;

a lug (11) protruding from said ridge (9) at an opposite side thereof with respect to said tab (10), for connecting said body (7) to a sports shoe (1,2,3,5,6).

4. The device according to claim 3, wherein said ridge (9) is an annular ridge (9), and wherein said lug (11) and said tab (10) protrude radially from said annular ridge (9).

5. In combination a sports shoe (1) comprising an upper (2, 3), a closeable member (5, 6) defined by said upper (2, 3), a band (16) having one end connected to said upper (2, 3), a free end (19) defined by said band (16), and a plurality of teeth (17) formed on one side of said band (16), and an engagement device (4) comprising;

a body (7) defining a head (8);

means (9, 10, 11, 12) for connecting said body (7) to said closeable member (5, 6);

a slot (13) formed in said head (8) for passage of said free end (19) of said band (16) therethrough;

a curved surface (20) formed in said head and facing said band (16), at a side thereof located opposite to said one side having said plurality of teeth (17) formed thereon, and;

toothed engagement means (18) located at said slot (13) at a side thereof opposite said curved surface (20) for releasably engaging said teeth (17) and fastening said closeable member (5, 6) against said upper (2, 3);

wherein said band (16) is movable within said slot (13) in a direction extending away from said toothed engagement means (18) and towards said curved surface (20) for disengaging said number of plurality of teeth (17) from said toothed engagement means (18) and releasing said closeable member (5, 6) from said upper (2, 3), and wherein said toothed engagement means (18) comprise a plurality of first teeth (18), said plurality of first teeth (18) progressively decreasing in size in a direction extending away from said curved surface (20).

6. The combination according to claim 5, wherein said means (9, 10, 11, 12) for connecting said body (7) to said closeable member (5, 6) comprise a hole (12) formed in said closeable member (5, 6) through a thickness thereof, a ridge (9) formed below said head (8) and extending through said hole (12), said ridge having a height approximately equal to said thickness of said closeable member (5, 6), a tab (10) protruding from said ridge (9) at one side thereof, and a lug (11) protruding from said ridge (9) at an opposite side thereof with respect to said tab (10), whereby to permit snap-together insertion of said body (7) in said hole (12) of said closeable member (5, 6).

7. The combination according to claim 6, wherein said ridge (9) is an annular ridge (9), and wherein said lug (11) and said tab (10) protrude radially from said annular ridge (9).

8. The combination according to claim 6, wherein said slot (13) extends transversely with respect to said tab (10).

9. The combination according to claim 6, further comprising a bottom (14) defined by said tab (10), and walls (21*a*, 21*b*) defined by said tab (10) laterally with respect to said bottom (14), said curved surface (20), said bottom (14) and said walls (21*a*, 21*b*) positioning said band (16) with said plurality of teeth (17) in engagement with said toothed engagement means (18).

10. In combination, a sports shoe (1) comprising an upper (2, 3), a closeable member (5, 6) defined by said upper (2, 3), a band (16) having one end connected to said upper (2, 3), a free end (19) defined by said band (16), and a plurality of teeth (17) formed on one side of said band (16), and an engagement device (4) comprising;

a body (7) defining a head (8);

means (9, 10, 11, 12) for connecting said body (7) to said closeable member (5, 6);

a slot (13) formed in said head (8) for passage of said free end (19) of said band (16) therethrough;

a curved surface (20) formed in said head (8) and facing said band (16), at a side thereof located opposite to said one side having said plurality of teeth (17) formed thereon;

toothed engagement means (18) located at said slot (13) at a side thereof opposite said curved surface (20) for releasably engaging said teeth (17) and fastening said closeable member (5, 6) against said upper (2, 3), and;

a bottom (14) defined by said means (9, 10, 11, 12) for connecting said body (7) to said closeable member (5, 6), said bottom (14), said toothed engagement means (18) and said curved surface (20) together defining a substantially S-shaped path for said band (16);

wherein said band (16) is movable within said slot (13) in a direction extending away from said toothed engagement means (18) and towards said curved surface (20) for disengaging said number of plurality of teeth (17) from said toothed engagement means (18) and releasing said closeable member (5, 6) from said upper (2, 3).

11. The combination according to claim 10, wherein said toothed engagement means (18) comprise a plurality of first teeth (18), said plurality of first teeth (18) progressively decreasing in size in a direction extending away from said curved surface (20).

12. The combination according to claim 10, wherein said means (9, 10, 11, 12) for connecting said body (7) to said closeable member (5, 6) comprise a hole (12) formed in said closeable member (5, 6) through a thickness thereof, a ridge (9) formed below said head (8) and extending through said hole (12), said ridge having a height approximately equal to said thickness of said closeable member (5, 6), a tab (10) protruding from said ridge (9) at one side thereof, and a lug (11) protruding from said ridge (9) at an opposite side thereof with respect to said tab (10), whereby to permit snap-together insertion of said body (7) in said hole (12) of said closeable member (5, 6).

13. The combination according to claim 12, wherein said ridge (9) is an annular ridge (9), and wherein said lug (11) and said tab (10) protrude radially from said annular ridge (9).

14. The combination according to claim 12, wherein said slot (13) extends transversely with respect to said tab (10).

15. The combination according to claim 12, wherein said bottom (14) is defined by said tab (10), said engagement device (4) further comprising walls (21*a*, 21*b*) defined by said tab (10), said walls (21*a*, 21*b*) extending laterally with respect to said bottom (14), said curved surface (20), said bottom (14) and said walls (21*a*, 21*b*) positioning said band (16) with said plurality of teeth (17) in engagement with said toothed engagement means (18).

* * * * *